United States Patent [19]

Aoyama

[11] Patent Number: 4,543,811

[45] Date of Patent: Oct. 1, 1985

[54] PROGRESSIVE FORMING METHOD OF PRODUCT HAVING VARIED CROSS-SECTIONAL LENGTH

[75] Inventor: Yasuaki Aoyama, Toyota, Japan

[73] Assignee: Toyota Jidosha Kabushiki Kaisha, Toyota, Japan

[21] Appl. No.: 476,339

[22] Filed: Mar. 17, 1983

[30] Foreign Application Priority Data

Sep. 14, 1982 [JP] Japan ..... 57-158748

[51] Int. Cl.[4] ..... B21D 24/16

[52] U.S. Cl. ..... 72/332; 72/379; 72/404

[58] Field of Search ..... 72/379, 404, 324, 326, 72/331, 332, 334, 338, 348, 349

[56] References Cited

U.S. PATENT DOCUMENTS

| | | | |
|---|---|---|---|
| 2,105,944 | 1/1938 | Graf | 72/378 |
| 2,332,478 | 10/1943 | Tolbert | 72/324 |
| 3,407,641 | 10/1968 | Jones | 72/379 |
| 4,114,417 | 9/1978 | LaVene | 72/404 |
| 4,195,510 | 4/1980 | Juergens | 72/379 |

FOREIGN PATENT DOCUMENTS

| | | | |
|---|---|---|---|
| 1943075 | 3/1971 | Fed. Rep. of Germany | 72/338 |

OTHER PUBLICATIONS

"Examples of Improvement in Press Forming and Mold Design," Nikkan Kogyo Shimbun (Daily Industry News) of Feb. 28, 1969, Tokyo, Japan.

*Primary Examiner*—Lowell A. Larson
*Attorney, Agent, or Firm*—Kenyon & Kenyon

[57] ABSTRACT

A progressive forming method of a product having a varied cross-sectional length in the direction of supply of strip material. A material is first drawn so that a portion which corresponds to the portion of the product having a cross-sectional length larger than the smallest cross-sectional length is processed. The material is elongated by an amount corresponding to the difference of the length from the smallest length. Operations that require no differential elongation in the direction of supply are all performed subsequently, since such operations do not require excess stock that must ultimately be scrapped.

9 Claims, 3 Drawing Figures

PROGRESSIVE FORMING METHOD OF PRODUCT HAVING VARIED CROSS-SECTIONAL LENGTH

BACKGROUND OF THE INVENTION

1. Field of the Invention

The present invention relates to a progressive forming method by a press machine, more particularly, to a progressive forming method capable of wasteless processing.

2. Description of the Prior Art

In progressive forming, a continuous strip material is intermittently moved and subjected successively to various types of processing, such as punching, slitting, forming, and finishing, to produce a continuous stream of products.

To increase the yield, it is necessary to decrease the amount of scrap or waste produced between adjacent products in the direction of supply of the strip material. Such "scrap-less" processing is easily attained when the product to be produced has a constant length in cross-section along the direction of supply. However, when the cross-sectional length is not constant, scrap-less processing is difficult.

That is, in the conventional technique, the desired cross-sectional profile of the product is obtained by one forming process. In such a forming process, there is little space for gripping the strip material in the direction of supply of the material. This, together with the fact the product to be produced has a varied length in the direction of supply, invariably results in slipping of the material. Since the cross-sectional length of the product varies in the direction of supply, the degree of slipping also varies in the direction of supply. The resultant product therefore ends up with uneven edges in that direction. Additional processing is necessary to remove the uneveness and give the product normal edges. This leads to the drawback of wasted material and a decreased yield.

SUMMARY OF THE INVENTION

An object of the present invention is to provide a method capable of overcoming the above-mentioned drawbacks encountered in the prior art.

Another object of the present invention is to provide a method capable of attaining progressive forming of high yield even with products with a varied cross-sectional length in the direction of supply of the material.

According to one aspect of the present invention a method is provided for producing, from a continuous strip material, a product having a varied cross-sectional length in a direction of supply of the strip material, said method comprising the steps of: intermittently supplying the strip material along a plurality of zones spaced from each other in the direction of supply of the material and successively subjecting the material to various types of processing, which at least include drawing, slitting, forming, and cutting, for obtaining from the material products having a varied cross-sectional length in the direction of supply of the material; the drawing being effected first in such a manner that a portion of the material corresponding to a portion of the product having a cross-sectional length larger than a minimum cross-sectional length of the product is shaped by plastically elongating the material for a length corresponding to a difference of the cross-sectional length of said portion of the product from the minimum cross-sectional length of the product.

According to another aspect of the present invention a die apparatus is provided for producing, from a strip material being intermittently supplied, a product having a varied cross-sectional length in the direction of supply of the material, the apparatus comprising: a first plate member extending in a direction of supply of the material; a second member extending parallel to the first plate member; a means for causing the first and second plates to be moved toward each other; and a die means arranged between the first and the second plate members for providing a plurality of stations spaced from each other in the direction of supply of the material where various types of processing including at least drawing, slitting, forming, and cutting, are simultaneously effected when the first and second members are moved toward each other; the arrangement of the stations being such that the station for the drawing is arranged at the first location in the direction of supply of the material, whereby a portion of the material corresponding to a portion of the product having a cross-sectional length larger than a minimum cross-sectional length of the product is plastically elongated.

BRIEF DESCRIPTION OF THE DRAWINGS

The present invention will now be described with reference to the attached drawings, in which.

DESCRIPTION OF THE PREFERRED EMBODIMENTS

Figure 1:
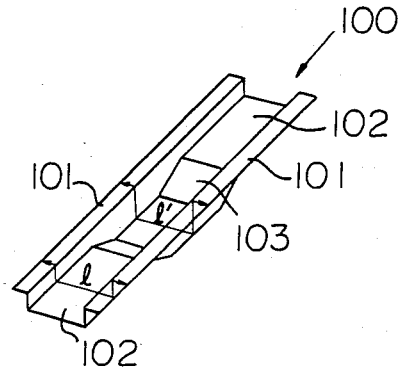
FIG. 1 is a perspective view of an example of a product produced by the present invention.

In FIG. 1, an example of a shape of a product produced according to the present invention is shown. The product 100 is formed as a channel member having flange portions 101. The channel member has side portions 102 of a small depth and a central portion 103 of a large depth. Thus, the channel member has different cross-sectional length, i.e., a small value l and a large value l'.

Figure 2:
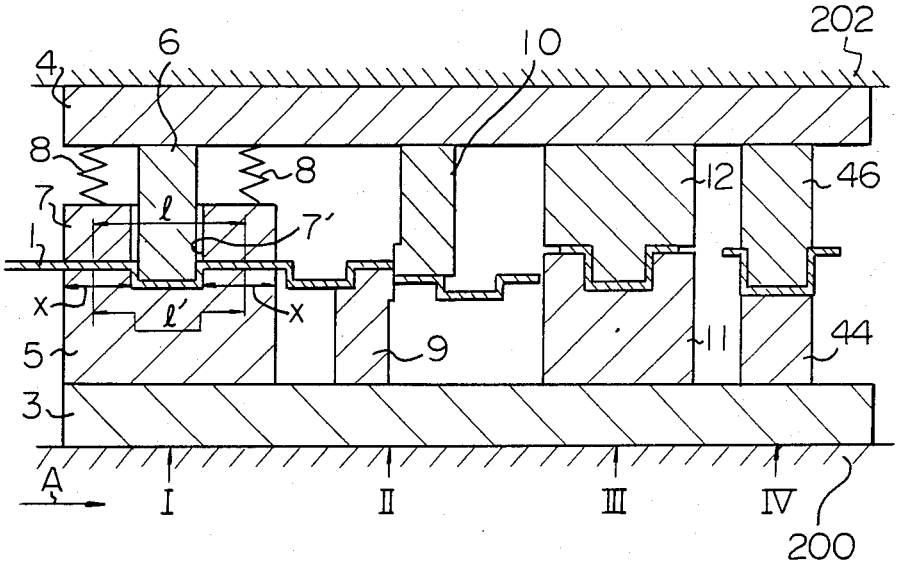
FIG. 2 shows an embodiment, in cross-section along the direction of supply, of a forming apparatus attaining the principle of the present invention.

In FIG. 2, there is shown a construction of a press mold for producing a product having the different cross-sectional length shown in FIG. 1. In FIG. 2, reference numeral 1 denotes a continuous strip member intermittently moved or supplied as shown by an arrow A by a conventional system (not shown). The apparatus includes a bolster 200 and a ram 202. A lower mold plate 3 is connected to the bolster 200 while an upper mold plate 4 is connected to the ram 202. Along the direction of supply of the strip material, shown by the arrow A, there are arranged a plurality of processing stations indicated by I, II, III, and IV.

Station I is a drawing station comprising a drawing die 5 fixedly connected to the lower plate 3 and a drawing punch 6 fixedly connected to the upper plate 4. Station I further includes an upper blank holder 7 which is suspended from the upper mold plate 4 by means of springs 8. The upper blank holder 7 includes a bore 7' by which the drawing punch 6 is guided. The springs 8 urge the holder 7 so that the strip member is positively held between the die 5 and the holder 7.

Station II is a slitting station comprising a lower cutter 9 connected to the lower mold plate 3 and an upper cutter 10 connected to the upper mold plate 4. These cutters 9 and 10 are provided with cooperating straight edges extending transversely to the direction of supply of the material.

Next to station II is located shaping station III. This station comprises a stamping die 11 connected to the lower mold plate 3 and a stamping punch 12 fixed to the upper mold plate 4.

The final separating station IV comprises a lower cutter 44 connected to the lower mold plate 3 and an upper cutter 46 connected to the upper mold plate 4. These cutters 44 and 46 are provided with cutting edges extending along the direction of supply of the material.

Figure 3:
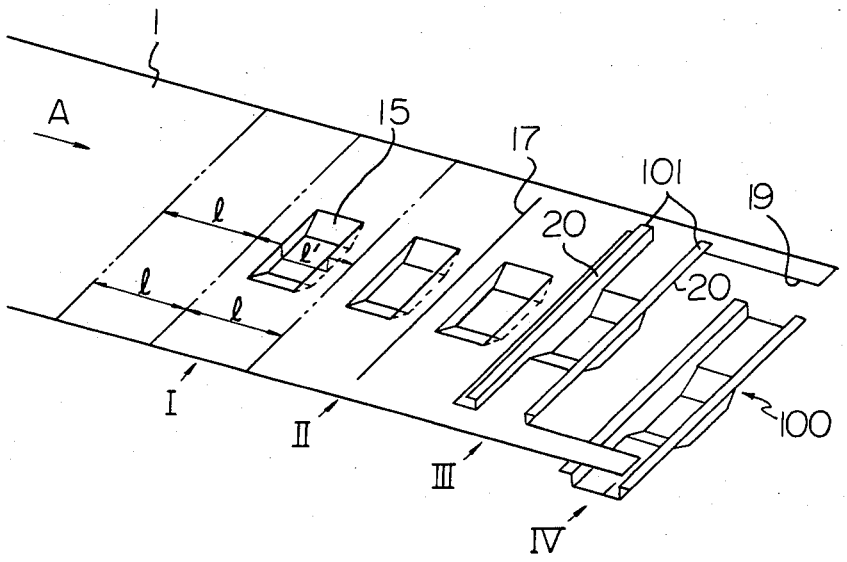
FIG. 3 is a perspective view of the principle of the present invention used to treat a strip to obtain a product.

The operation of the present invention is now described with reference to FIGS. 2 and 3. The continuous strip 1, supplied as shown by the arrow A, is subjected to the drawing process at station I. The upper mold plate 4 is moved by means of the ram 202 toward the lower mold plate 3 on the bolster 200 so that a recess portion 15 is formed on the strip member 1 by means of the drawing die 5 and the drawing punch 6. During the formation of the recess 15, the strip member 1 is held between the die 5 and the holder 7. In this case, the springs 8 urge the holder 7 toward the die 5 so that the strip 1 is positively held therebetween to prevent wrinkling. Since the strip 1 is held between the holder 7 and the die 5 at a portion of enlarged length X, the strip is subjected to the drawing process without slipping of the material from the holder 7 to the die 5. In other words, a process wherein the material is plastically elongated is carried out. In this case, the arrangement of the mold is such that the portion of the material which corresponds to the portion of the product having a length larger than the minimum cross-sectional length is processed to allow the material to be elongated for a length corresponding to the difference from the smallest cross-sectional length.

The processing of the stations after the drawing station I is substantially the same as the prior art. At station II, the cutters 9 and 10 cooperate to cut a portion of the material along a line transverse to the direction of supply of the material to form a slit 17. At station III, the stamping device comprising the punch 12 and the die 11 performs forming work to provide a pair of flange portions 101. At station IV, the cutters 44 and 46 cooperate to cut a portion of the material along lines in the direction of supply of the material to separate the product 100.

As explained above, the present invention effects a drawing process, while clamping a length of the material sufficient to prevent slipping, prior to the other processing. As a result, the material is elongated for a length corresponding to the difference from the smallest cross-sectional length. Thus, no slipping takes place in the subsequent processing, and an edge 20 of the material obtained by slitting may correspond to an edge of the product. This eliminates the necessity of cutting the product to produce straight edges, thereby preventing waste which would otherwise be produced and increasing the yield. The lack of necessity of a process to cut the product to produce straight edges means there is no need for an additional cutter and a chute for removal of the waste.

While the present invention is described with reference to the attached drawings, many modifications and changes may be made by those skilled in this art without departing from the scope of the present invention.

I claim:

1. A method for producing, from a continuous strip of plastically deformable material, a plurality of products in the form of substantially U-shaped cross section channel members, each product having a varied cross-sectional length in a direction of supply of the strip of the material, said method comprising the steps of:

intermittently supplying the strip of material along a plurality of processing zones spaced from each other in the direction of the supply of the material, and successively subjecting the material in successive zones to various processing steps between successive supplying steps, which processing steps at least include drawing, slitting, forming, and cutting, for obtaining from the material products having a varied cross-sectional length in the direction of supply of the material, wherein the improvement comprises:

first drawing the material in such a manner that each portion of the material corresponding to a portion of the product having a cross-sectional length greater than the minimum cross-sectional length of the product is shaped by plastically elongating the portion of the material by an amount corresponding to a difference of the cross-sectional length of said portion of the product from the minimum cross-sectional length of the product;

after all drawing steps, slitting the material to form a slit which extends transversely to the direction of the supply of the material; and finally, cutting the material along lines parallel to the direction of supply of the material, to separate the obtained product from the remainder of the strip of the material, wherein the edges produced by said slitting transverse to the direction of the supply of the material are the total final edges of the product in the form of a U-shaped section channel member in said transverse direction, thereby attaining a scrap-less process in the direction of supply of the material.

2. A method according to claim 1, wherein the method comprises, after the slitting step, bending the material to form a flange portion of the product.

3. A die apparatus for producing, from a strip of material being intermittently supplied, a product in the form of a substantially U-shaped cross section channel member having a varied cross-sectional length in the direction of supply of the material, said apparatus comprising:

a first plate member extending in the direction of supply of the material;

a second plate member extending parallel to the first plate member;

a means for causing the first and second plates to be moved toward each other; and a die means arranged between the first and the second plate members, said die means having a plurality of processing stations spaced from each other in the direction of supply of the material, where various types of processing steps, including at least drawing, slitting, forming, and cutting, are simultaneously effected when the first and second members are moved toward each other;

the arrangement of the processing stations being such that the station for the drawing step is arranged as the first processing station in the direction of supply of the material, said die means for said drawing station comprising means for clamping the material transversely to the direction of supply before and behind a portion of the material to be drawn and means for differentially plastically elongating said portion of the material to be drawn, whereby a portion of the material corresponding to a portion of the product having a cross-sectional length larger than a minimum cross-sectional length of the product is plastically elongated, such that the slitting station is arranged downstream of the final drawing station to form a slit in the material which extends transversely to the direction of the supply of the material, and such that the cutting station is arranged as the last station to cut the material along lines parallel to the direction of supply of the material, for separating the obtained product from the remainder of the strip of the material, wherein the edges produced by said slitting in the direction of the supply of the material are the total final edges of the product in the form of a U-shaped cross section channel member in said transverse direction, thereby attaining a scrap-less process in the direction of supply of the material.

4. A die apparatus according to claim 3, wherein the means for differentially plastically elongating the portion of material to be drawn comprises a drawing die connected to the first plate and a drawing punch connected to the second plate.

5. A die apparatus according to claim 4, wherein said means for clamping the material transversely before and behind a portion of the material to be drawn comprises:

a holder having a hole through which the drawing punch passes and a spring means for urging the holder toward the drawing die so that the material subjected to the drawing process is positively held.

6. A die apparatus according to claim 3, wherein said die means further comprises a plurality of die sets corresponding to the stations for effecting slitting, forming, and cutting, each of said die sets comprising a first working member connected to the first plate member and a second working member connected to said second plate.

7. A die apparatus according to claim 6, wherein the first working member of the die set for slitting comprises a first cutter having an edge extending transversely to the direction of supply of the material and connected to the first plate, and the second working member of the die set for slitting comprises a second cutter having an edge extending transversely to said direction of supply of the material, said edges cooperating with each other to form the slit.

8. A die apparatus according to claim 6, wherein the first working chamber of the die set for forming comprises a stamping die connected to the first plate, and the second working member of the die set for forming comprises a stamping punch connected to the second plate, said die and punch cooperating to form a flange portion of the product.

9. A die apparatus according to claim 6 wherein the first working member of the die set for cutting comprises a first cutting means connected to the first plate and having a pair of parallel spaced edges extending in the direction of supply of the material and the second working member of the die set for cutting comprises a second cutter means connected to the second plate and having a corresponding pair of parallel spaced edges extending in the direction of supply of the material, said pair of edges of the first cutting means cooperating with the corresponding pair of edges of the second cutter means for separating the finished products from the material.

* * * * *